US012365025B2

(12) United States Patent
Komoda et al.

(10) Patent No.: US 12,365,025 B2
(45) Date of Patent: Jul. 22, 2025

(54) FINE METAL LINEAR BODY

(71) Applicant: Mitsui Mining & Smelting Co., Ltd., Tokyo (JP)

(72) Inventors: Yasuo Komoda, Ageo (JP); Yasuhiro Shibata, Ageo (JP); Yoshinori Shimizu, Ageo (JP); Ikuhiro Ozawa, Ageo (JP)

(73) Assignee: MITSUI MINING & SMELTING CO., LTD. (JP)

( * ) Notice: Subject to any disclaimer, the term of this patent is extended or adjusted under 35 U.S.C. 154(b) by 120 days.

(21) Appl. No.: 17/928,640

(22) PCT Filed: Jul. 6, 2021

(86) PCT No.: PCT/JP2021/025476
§ 371 (c)(1),
(2) Date: Nov. 30, 2022

(87) PCT Pub. No.: WO2022/009886
PCT Pub. Date: Jan. 13, 2022

(65) Prior Publication Data

US 2023/0256506 A1 Aug. 17, 2023

(30) Foreign Application Priority Data

Jul. 8, 2020 (JP) ..... 2020-117661

(51) Int. Cl.
*B22F 1/05* (2022.01)
*B22F 9/24* (2006.01)
*C25D 1/04* (2006.01)

(52) U.S. Cl.
CPC ..... *B22F 1/05* (2022.01); *B22F 9/24* (2013.01); *C25D 1/04* (2013.01); *B22F 2301/10* (2013.01); *B22F 2304/10* (2013.01)

(58) Field of Classification Search
None
See application file for complete search history.

(56) References Cited

U.S. PATENT DOCUMENTS

2009/0291302 A1 11/2009 Shimotsuma et al.
2009/0316335 A1* 12/2009 Simon ..... H01M 4/75 429/188

(Continued)

FOREIGN PATENT DOCUMENTS

CN 104018189 A * 9/2014 ..... B82Y 40/00
JP 2008-545881 A 12/2008

(Continued)

OTHER PUBLICATIONS

Huang—nanowire arrays electrodeposition—Adv. Mat.—Euro D1—B 2002 (Year: 2002).*

(Continued)

*Primary Examiner* — John Vincent Lawler
(74) *Attorney, Agent, or Firm* — Harness, Dickey & Pierce, P.L.C.

(57) ABSTRACT

A fine metal linear body is provided in which the sintering temperature is lower than that in conventional examples. The fine metal linear body has a length of 0.5 to 200 μm and a thickness of 30 nm to 10 μm. When a length of a crystal of a metal constituting the fine metal linear body, in a direction in which the fine metal linear body extends, is taken as X, and a length thereof in a direction orthogonal to the direction is taken as Y, an X/Y value, which is a ratio of the X to the Y, is 4 or less, in three boundary regions when dividing the length of the fine metal linear body into four equal parts along the extending direction.

16 Claims, 3 Drawing Sheets

Example 1 EBSD image

(56) References Cited

U.S. PATENT DOCUMENTS

| | | | |
|---|---|---|---|
| 2018/0051176 | A1 | 2/2018 | Okada et al. |
| 2018/0326478 | A1 | 11/2018 | Morinaka et al. |

FOREIGN PATENT DOCUMENTS

| | | | | | |
|---|---|---|---|---|---|
| JP | 2009299103 | A | | 12/2009 | |
| JP | 2014037602 | A | * | 2/2014 | ..... B22F 1/00 |
| JP | 2020-515712 | A | | 5/2020 | |
| JP | 2021-139045 | A | | 9/2021 | |
| WO | 2008001658 | A1 | | 1/2008 | |
| WO | 2015-097808 | A1 | | 7/2015 | |
| WO | 2016151858 | A1 | | 9/2016 | |
| WO | 2017094361 | A1 | | 6/2017 | |
| WO | WO-2018162681 | A1 | * | 9/2018 | ..... B82Y 40/00 |

OTHER PUBLICATIONS

Saito—JP 2014-037602 A—PCT D1—MT—nanowire—2014 (Year: 2014).*
Guo—CN 104018189 A—Euro D2—MT—nanowire—2014 (Year: 2014).*
Kim—ethylenediamine-promotes-cu-nanowire-growth-by-inhibiting-oxidation-of-cu(111)—JACS—Dec. 2016 (Year: 2016).*
Birlem—WO 2018-162681 A1—PCT D2—MT—plurality of nanowires—2018 (Year: 2018).*
International Search Report (English and Japanese) issued in PCT/JP2021/025476, mailed Sep. 14, 2021; ISA/JP (5 pages).
M. J. Kim, et. al., "Ethylenediamine Promotes Cu Nanowire Growth by inhibiting Oxidation of Cu(111)", Journal of the American Chemical Society, 2017, vol. 139, p. 277-284 (24 pages).
Limin Huang et al. "Nanowire Arrays Electrodeposited from Liquid Crystalline Phases"; Advanced Materials; Published by WILEY-VCH Verlag GmbH; pp. 61-64; Jan. 4, 2002 (total 4 pages).

* cited by examiner

Example 1 (2000x)

Example 1 (10000x)

Example 1 (30000x)

Comparative Example 1 (2000x)

Comparative Example 1 (10000x)

Comparative Example 1 (30000x)

Example 1 EBSD image

Comparative Example 1 EBSD image

FINE METAL LINEAR BODY

CROSS REFERENCE TO RELATED APPLICATIONS

This application is a U.S. National Phase Application under 35 U.S.C. 371 of International Application No. PCT/JP2021/025476, filed on Jul. 6, 2021, which claims priority to Japanese Patent Application No. 2020-117661, filed on Jul. 8, 2020. The entire disclosures of the above applications are expressly incorporated by reference herein.

BACKGROUND

Technical Field

The present invention relates to a fine metal linear body.

Related Art

So-called nanowires are expected to exhibit physical and chemical properties (e.g., electrical conductivity, thermal conductivity, luminescence properties, catalytic activity, etc.) not found in conventional materials, due to their minute size, high aspect ratio, and the like. Conventional techniques regarding production of such nanowires are known from WO 2015/097808 and M. J. Kim, et. al., Journal of the American Chemical Society, 2017, vol. 139, p. 277-284.

WO 2015/097808 describes a method for producing a copper nanowire using an electroless method by adding hydrazine as a reducing agent to an aqueous solution containing ethylenediamine, o-phenylenediamine, and copper nitrate. In this method, the fact that ethylenediamine and o-phenylenediamine are likely to be adsorbed on the (001) and (111) planes of copper but unlikely to be adsorbed on the (110) plane thereof is used to selectively deposit copper on the (110) plane, thereby forming a wire-like shape. M. J. Kim, et. al., Journal of the American Chemical Society, 2017, vol. 139, p. 277-284 also describes a method for producing a copper nanowire using an electroless method.

In a copper nanowire produced using the method described in WO 2015/097808, due to its formation mechanism, the copper crystal is an elongated and large monocrystal with its [110] orientation preferentially oriented in the longitudinal direction of the wire. It is known that the smaller the crystal size, the lower the sintering temperature of a metal powder, that is, it is not easy to lower the sintering temperature of a copper nanowire produced using the method described in WO 2015/097808 in which the crystal size inevitably increases.

Accordingly, it is an object of the present invention to provide a fine metal linear body in which the sintering temperature is lower than that in conventional examples, or, in the case of the same heating temperature, the electrical resistance of a sintered portion after the heat treatment is smaller than that in conventional examples.

SUMMARY

The present invention is directed to a fine metal linear body with a length of 0.5 to 200 μm and a thickness of 30 nm to 10 μm, in which, when a length of a crystal of a metal constituting the fine metal linear body, in a direction in which the fine metal linear body extends, is taken as X, and a length thereof in a direction orthogonal to the direction is taken as Y, the crystal has an arithmetic mean of an X/Y value, which is a ratio of the X to the Y, of 4 or less, in three boundary regions when dividing the length of the fine metal linear body into four equal parts along the extending direction.

The present invention is directed to a fine metal linear body with a length of 0.5 to 200 μm and a thickness of 30 nm to 10 μm, in which, when a length of a crystal of a metal constituting the fine metal linear body, in a direction orthogonal to a direction in which the fine metal linear body extends, is taken as Y, the crystal has an arithmetic mean of the Y of 10 nm or less, in three boundary regions when dividing the length of the fine metal linear body into four equal parts along the extending direction.

Furthermore, the present invention is directed to a fine metal linear body with a length of 0.5 to 200 μm and a thickness of 30 nm to 10 μm, in which a crystal of a metal constituting the fine metal linear body has a proportion of crystal grains in a [110] orientation of 50% or less, as evaluated through electron diffraction using a transmission electron microscope or electron backscatter diffraction within ±30° of a direction in which the fine metal linear body extends, in three boundary regions when dividing the length of the fine metal linear body into four equal parts along the extending direction.

Furthermore, the present invention is directed to a method for producing a fine metal linear body using a metal as a base material, including a step of depositing the metal on a cathode through electrolytic reduction using an electrolyte containing a metal element source, in which the electrolytic reduction is performed in a state in which an oily substance is present on a surface of the cathode.

DETAILED DESCRIPTION

Figure 1:
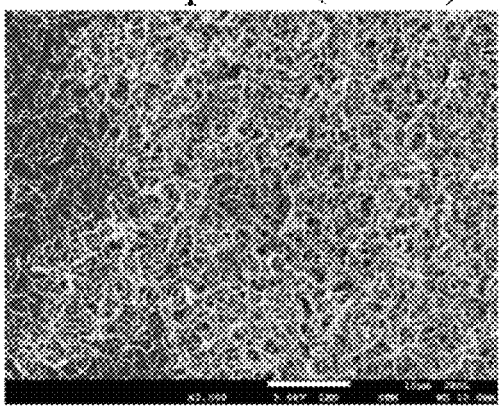
FIG. 1 shows scanning electron microscope images of fine metal linear bodies obtained in Example 1.
Figure 1:
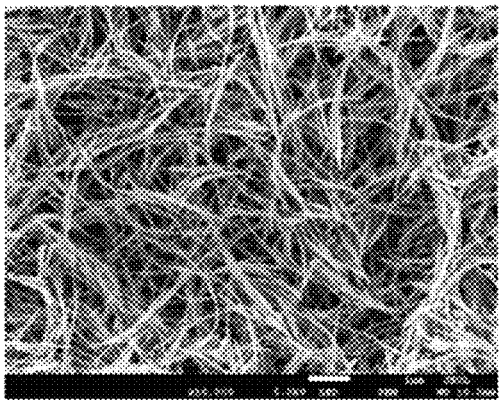
Figure 1:
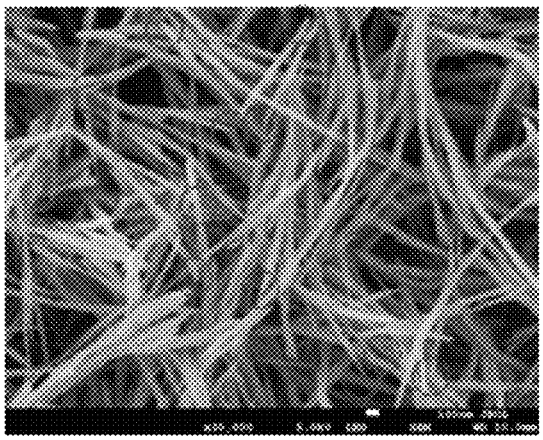

Hereinafter, the present invention will be described with reference to a preferred embodiment thereof. The present invention relates to a fine metal linear body. In the following description, the term "fine metal linear body" may refer to a single linear body or an aggregate of a plurality of linear bodies, depending on the context. The fine metal linear body of the present invention is made of metal. The fine metal linear body typically extends in one direction. The state in which the linear body extends in one direction varies depending on the state of the linear body during observation. For example, the linear body may extend in a straight line or meander in a curved line in one direction. The linear body is characterized by being long in spite of being very thin.

The fine metal linear body is very thin, and its thickness is preferably from 30 nm to 10 μm, more preferably from 30 to 1000 nm, even more preferably from 40 to 500 nm, and even more preferably from 45 to 300 nm. In spite of being very thin in this manner, the fine metal linear body is long, and its length is preferably from 0.5 to 200 μm, more preferably from 1 to 100 μm, and even more preferably from 2 to 70 μm. Since the fine metal linear body has both the thickness and length mentioned above, it is excellent in terms of processability such as filling properties when used as a bonding material.

Furthermore, the fine metal linear body has an aspect ratio ((length of fine metal linear body [m])/(thickness of fine metal linear body [m])) of preferably 5 to 5000, more preferably 10 to 5000, even more preferably 20 to 5000, even more preferably 20 to 3000, and even more preferably 20 to 1500.

The above-mentioned thickness is obtained by reading the thicknesses of 10 or more fine metal linear bodies from an electron microscope image and calculating their arithmetic mean. The above-mentioned length is obtained by reading the lengths of 20 or more fine metal linear bodies from an electron microscope image and calculating their arithmetic mean.

The fine metal linear body may have a shape in which the thickness is substantially uniform over its entire length or a bead-like shape whose thickness is not uniform. At least one end of the fine metal linear body is preferably tapered. The term "tapered" refers to a shape in which it is seen from an observation of an end region of the fine metal linear body that its thickness gradually decreases toward the end.

Since at least one end of the fine metal linear body is tapered, when such fine metal linear bodies are used as a material for wiring material, for example, the fine metal linear bodies can be connected to each other in the direction in which they extend (hereinafter also referred to as a "longitudinal direction") not at the cross sectional faces of the fine metal linear bodies but at the side faces of the thin portions of the fine metal linear bodies. That is to say, since the side faces have a larger area than the cross sectional faces of the linear bodies, the contact area between the fine metal linear bodies can be increased, which has the advantage of reducing resistance at the interface. Furthermore, this configuration is also preferable because a gap between the fine metal linear bodies can be reduced, which reduces the resistance.

From the viewpoint of making this advantage more remarkable, the angle of the tapered end is preferably 60 degrees or less, more preferably 50 degrees or less, and even more preferably 45 degrees or less.

Note that the "direction in which the fine metal linear body extends" means the longitudinal direction of the fine metal linear body as described above, and, if the fine metal linear body includes a curved portion, this term refers to the tangential direction.

The angle of the tapered end is measured as follows. First, the thickness of the fine metal linear body is measured from an electron microscope image as described above. Next, an arc with a diameter that is the same as the thickness of the fine metal linear body is drawn about the tip of the end of the fine metal linear body, and two intersecting points between the arc and the fine metal linear body are obtained. The angle formed by straight lines connecting the two intersecting points and the tip of the end of the fine metal linear body is measured as the angle of the end. If the cross-section at the end of the fine metal linear body is in the shape of a straight line or substantially in the shape of a straight line, the center portion thereof is taken as the tip of the end. Furthermore, if the cross-section at the end of the fine metal linear body is in the shape of a straight line or substantially in the shape of a straight line and the length of the cross section is more than one-half of the thickness of the fine metal linear body, the fine metal linear body is not subjected to the measurement. This measurement is performed on 10 or more fine metal linear bodies, and their arithmetic mean is taken as the angle of the tapered end.

The fine metal linear body is typically in the shape of a linear body extending in one direction, but may or may not have a main chain portion extending in one direction and a branching portion branching from a point in the main chain portion. From the viewpoint of allowing a small amount of fine metal linear body to impart sufficient conductivity to a target and suppressing a decrease in the conductivity of the target to which conductivity has been imparted when the target is stretched or bent, the fine metal linear body is preferably a non-branching structure having only the main chain portion. Meanwhile, from the viewpoint of allowing an aggregate of fine metal linear bodies to have a bulky structure, the fine metal linear bodies preferably each have one or at least two branching portions.

There is no particular limitation on the type of metal for forming the fine metal linear body, and various metals can be used. Considering the balance between high conductivity and ease of industrial use, it is preferable to use at least one metal selected from the group consisting of copper, silver, gold, nickel, lead, palladium, platinum, cobalt, tin, iron, bismuth, and zinc, or an alloy containing the metal. Alternatively, crystals of these plurality of metals or crystals of the alloys may be mixed together to form a linear body. Among these materials, it is preferable to use copper, a copper alloy, zinc, or a zinc alloy as a base material of the linear body, and more preferable to use copper or a copper alloy as a base material of the linear body. Note that "use copper or zinc as a base material" refers to a state in which the proportion of copper or zinc contained in the fine metal linear body is 80 mass % or more. Note that examples of the state in which crystals of the plurality of metals or crystals of the alloys are mixed together include a state in which crystals of different metals are interlinked as in Cu crystal-Zn crystal-Cu crystal-Zn crystal.

The fine metal linear body may have a structure including a main portion constituted by a first metal element or an alloy containing the metal element, and a coating layer constituted by a second metal element other than the first metal element and arranged on the surface of the main portion.

Examples of the first metal element include, as described above, copper, silver, gold, nickel, lead, palladium, platinum, cobalt, tin, iron, bismuth, and zinc. Examples of the second metal element include, providing that the second metal element is different from the first metal element, silver, cobalt, iron, nickel, zinc, lead, tin, platinum, gold, palladium, copper, and bismuth, and an alloy containing one or at least two of these metals (e.g., a nickel alloy, an iron alloy, etc.). In particular, the second metal element preferably has higher conductivity than the first metal element or an alloy of the metal element constituting the main portion, from the viewpoint of further increasing the conductivity that is to be imparted to the target. From this point of view, if the first metal element is, for example, copper or zinc, the second metal element is preferably silver.

In order to form a coating layer on the surface of the main portion, for example, it is possible to use a method in which a main portion is formed using a later-described method and then subjected to electrolytic plating in an electrolyte containing a metal element for coating, a method in which a catalyst that enables substitution plating or electroless plating is applied to a fine metal linear body and then plating with a target metal is performed, or a dry method. Furthermore, the surface of the linear body may be treated with an organic agent.

The fine metal linear body of the present invention is different from conventionally known fine metal linear bodies, in terms of the crystalline structure. Specifically, the fine metal linear body of the present invention has a polycrystalline structure in which a plurality of crystals are interlinked in the extending direction of the linear body. On the other hand, conventionally known fine metal linear bodies, such as the fine metal linear body produced using the electroless method described in WO 2015/097808, have a monocrystalline structure in which an elongated and large crystal is present in the extending direction of the linear bodies. According to the fine metal linear body of the present invention, due to its characteristic crystalline structure, it is possible to make the sintering temperature lower than that in conventional examples. Alternatively, in the case of performing heat treatment at the same heating temperature as conventional fine metal linear bodies, it is possible to make the electrical resistance of a sintered portion after the heat treatment smaller than that in conventional examples.

Hereinafter, the crystalline structure of the fine metal linear body of the present invention will be described in detail. When the length of a crystal of a metal constituting the fine metal linear body, in a longitudinal direction of the fine metal linear body, is taken as X, and the length thereof in a direction (hereinafter also referred to as a "width direction") orthogonal to this direction is taken as Y, an X/Y value, which is a ratio of the X to the Y, is preferably 4 or less.

In this manner, the crystal of the metal constituting the fine metal linear body of the present invention has a substantially isotropic shape with no significant difference between the length in the longitudinal direction and the length in the width direction. The fine metal linear body of the present invention has a thickness of 30 nm to 10 μm as described above, and thus it is seen that the crystal of the metal constituting the fine metal linear body is a fine crystal. Since the crystal of the metal constituting the fine metal linear body of the present invention has such a structure, as described above, according to the fine metal linear body of the present invention, it is possible to make the sintering temperature lower than that in conventional examples. Alternatively, in the case of performing heat treatment at the same heating temperature as conventional fine metal linear bodies, it is possible to make the electrical resistance of a sintered portion after the heat treatment smaller than that in conventional examples.

From the viewpoint of making this advantage more remarkable, the X/Y value is more preferably 3 or less.

The above-mentioned X/Y value is obtained by calculating X/Y values of the crystal in three boundary regions when dividing the length of the fine metal linear body into four equal parts along the longitudinal direction, and calculating their arithmetic mean. The first decimal place of the arithmetic mean is rounded off.

The "crystal" as used in the present description refers to crystal grains, and the size thereof can be obtained from a grain map obtained through electron backscatter diffraction (hereinafter also referred to as "EBSD"). It should be noted that a crystal grain is a different concept from a crystallite size obtained from an XRD pattern. If the crystal as used in the present description is a twin crystal, crystals constituting the twin crystal are regarded as different crystals, and an X/Y value is obtained for each crystal.

If the X/Y value is 4 or less, there is no limitation on the X and Y values, but, from the viewpoint of making the sintering temperature lower than that in conventional examples, the X value is preferably 10 μm or less, more preferably from 5 nm to 2 μm, and even more preferably from 10 to 500 nm. From a similar point of view, the Y value is preferably 3 μm or less, more preferably from 5 nm to 1 μm, even more preferably from 10 to 400 nm, and even more preferably from 10 to 200 nm.

The fine metal linear body of the present invention is also characterized by the above-mentioned Y value alone. That is to say, the Y value is preferably 10 nm or less.

"Y is 10 nm or less" refers to a state in which the fine metal linear body has a thin shape with a width corresponding to only 100 or less atoms when expressed in terms of the number of metal atoms. This aspect has the same meaning as that the crystal is a fine crystal, as well as the design concept of setting the X/Y value to 4 or less. Due to this fact, according to the fine metal linear body of the present invention, it is possible to make the sintering temperature lower than that in conventional examples. Alternatively, in the case of performing heat treatment at the same heating temperature as conventional fine metal linear bodies, it is possible to make the electrical resistance of a sintered portion after the heat treatment smaller than that in conventional examples. Note that, as long as Y is 10 nm or less, there is no limitation on the X/Y value.

The above-mentioned Y value is obtained by calculating Y values of the crystal in three boundary regions when dividing the length of the fine metal linear body into four equal parts along the longitudinal direction, and calculating their arithmetic mean. The first decimal place of the arithmetic mean is rounded off.

The fine metal linear body of the present invention is also characterized by the orientation of the crystal of the metal constituting the fine metal linear body.

Specifically, focusing on the crystal in three boundary regions when dividing the length of the fine metal linear body of the present invention into four equal parts along the extending direction, the proportion of crystal grains in the [110] orientation as evaluated through electron diffraction using a transmission electron microscope (hereinafter also referred to as a "TEM") or EBSD within ±30° of the direction in which the fine metal linear body extends is preferably 50% or less, more preferably 45% or less, and even more preferably 40% or less. Satisfying this relationship means that the [110] orientation of the crystal is not preferentially oriented in the longitudinal direction of the fine metal linear body.

The proportion of crystal grains in the [110] orientation is calculated by arbitrarily extracting two or more fine metal linear bodies, drawing boundary lines dividing the length of each fine metal linear body into four equal parts along the longitudinal direction, and performing measurement in three boundary regions serving as the boundaries.

When performing evaluation through TEM electron diffraction, the proportion is the percentage of crystal grains in the [110] orientation measured at six or more points in total, which are midpoints of the boundary lines of the boundary regions (e.g., six points when two fine metal linear bodies are extracted, or 15 points when five fine metal linear bodies are extracted).

When performing evaluation using EBSD, the measurement is performed at 18 or more points in total, which are three points dividing a boundary line of each boundary region into four equal parts (e.g., 18 points when two fine metal linear bodies are extracted, or 45 points when five fine metal linear bodies are extracted).

The first decimal place of the percentage is rounded off.

When observing crystal grains in the [110] orientation using TEM, electrons are transmitted through the fine metal linear body to perform the observation. However, if the thickness of the fine metal linear body is 200 nm or more, electrons do not penetrate the fine metal linear body, and the desired electron diffraction pattern cannot be obtained. Thus, if the thickness of the fine metal linear body is 200 nm or more, the proportion of crystal grains in the [110] orientation is evaluated using EBSD.

On the other hand, conventionally known fine metal linear bodies, such as the fine metal linear body produced using the electroless method described in WO 2015/097808, have a [110] orientation preferentially oriented in the longitudinal direction of the linear bodies, due to their production method.

Furthermore, the synthesis of a fine metal linear body using an electroless method is also reported in M. J. Kim, et. al., Journal of the American Chemical Society, 2017, vol. 139, p. 277-284. As described in Comparative Example below, the inventor's experiments revealed that the fine metal linear body synthesized using the electroless method of M. J. Kim, et. al., Journal of the American Chemical Society, 2017, vol. 139, p. 277-284 also has a [110] orientation preferentially oriented in the longitudinal direction. This literature states that the side face of the fine metal linear body is a (100) plane. This literature states that a (100) plane is more likely to be oxidized than other planes, and an oxide film is formed on the surface. That is to say, the side face of the fine metal linear body with a [110] orientation preferentially oriented in the longitudinal direction is likely to be oxidized, which is one of the factors that increase the resistance of the fine metal linear body in the width direction. Therefore, the fine metal linear body of the present invention, which is a fine metal linear body that does not grow in the [110] orientation in the longitudinal direction, has the advantage of being unlikely to be oxidized.

According to the fine metal linear body of the present invention with a [110] orientation of the crystal not preferentially oriented in the longitudinal direction, due to its characteristic crystalline structure, it is possible to make the sintering temperature lower than that in conventional examples. Alternatively, in the case of performing heat treatment at the same heating temperature as conventional fine metal linear bodies, it is possible to make the electrical resistance of a sintered portion after the heat treatment smaller than that in conventional examples.

From the viewpoint of making the sintering temperature lower than that in conventional examples, in the crystal in three boundary regions when dividing the length of the fine metal linear body into four equal parts along the extending direction, the proportion of crystal grains in the [111] orientation as evaluated through TEM electron diffraction or EBSD within ±30° of the direction in which the fine metal linear body extends is preferably 50% or more, more preferably 52% or more, even more preferably 60% or more, and even more preferably 70% or more.

The proportion of crystal grains in the [111] orientation is calculated by arbitrarily extracting two or more fine metal linear bodies, drawing boundary lines dividing the length of each fine metal linear body into four equal parts along the longitudinal direction, and performing measurement in three boundary regions serving as the boundaries.

When performing evaluation through TEM electron diffraction, the proportion is the percentage of crystal grains in the [111] orientation measured at six or more points in total, which are midpoints of the boundary lines of the boundary regions (e.g., six points when two fine metal linear bodies are extracted, or 15 points when five fine metal linear bodies are extracted).

When performing evaluation using EBSD, the measurement is performed at 18 or more points in total, which are three points dividing a boundary line of each boundary region into four equal parts (e.g., 18 points when two fine metal linear bodies are extracted, or 45 points when five fine metal linear bodies are extracted).

The first decimal place of the percentage is rounded off.

Satisfying this relationship means that the [111] orientation is preferentially oriented in the longitudinal direction of the fine metal linear body. The state in which the [111] orientation of the crystal is preferentially oriented in the longitudinal direction preferable because it crystallographically means that the (100) plane is not exposed on the side face.

Furthermore, in the crystal in three boundary regions when dividing the length of the fine metal linear body into four equal parts along the extending direction, the proportions of crystal grains in all of the [100], [110], and [111] orientations as evaluated through TEM electron diffraction or EBSD within ±30° of the direction in which the fine metal linear body extends are preferably 50% or less, and more preferably 40% or less.

The proportion of crystal grains in the [110], [111], and [100] orientations is calculated by arbitrarily extracting two or more fine metal linear bodies, drawing boundary lines dividing the length of each fine metal linear body into four equal parts along the longitudinal direction, and performing measurement in three boundary regions serving as the boundaries.

When performing evaluation through TEM electron diffraction, the proportion is the percentage of crystal grains in the [110], [111], and [100] orientations measured at six or more points in total, which are midpoints of the boundary lines of the boundary regions (e.g., six points when two fine metal linear bodies are extracted, or 15 points when five fine metal linear bodies are extracted).

When performing evaluation using EBSD, the measurement is performed at 18 or more points in total, which are three points dividing a boundary line of each boundary region into four equal parts (e.g., 18 points when two fine metal linear bodies are extracted, or 45 points when five fine metal linear bodies are extracted).

The first decimal place of the percentage is rounded off.

Satisfying this relationship means that the crystals of the metal constituting the fine metal linear body are randomly oriented. The state in which the crystals of the metal constituting the fine metal linear body are randomly oriented means that the crystals of the metal constituting the fine metal linear body are polycrystalline and the crystal size is small. The state in which the crystal size is small leads to lower sintering temperatures as described above. Moreover, "crystals are randomly oriented" means that the (100) plane is not preferentially exposed on the side face of the linear body, which means that oxidation of the side face of the fine metal linear body is not facilitated.

If the fine metal linear body of the present invention is an aggregate including a plurality of fine metal linear bodies, in the aggregate, the number of fine metal linear bodies having a curved portion whose radius of curvature is 5 times or less the length of each fine metal linear body is preferably 5% or more, more preferably 20% or more, even more preferably 40% or more, and even more preferably 60% or more, of the total number of fine metal linear bodies in the aggregate. With this configuration, it is easy to realize contact across a plurality of fine metal linear bodies along the transverse (width) direction of the fine metal linear bodies, which is preferable because the resistance of the aggregate of the fine metal linear bodies decreases.

The radius of curvature is calculated as follows. A fine metal linear body is observed using a scanning electron microscope (hereinafter also referred to as a "SEM"). A straight line connecting the two ends of the fine metal linear body is drawn and its length (chord length) is measured. Moreover, an auxiliary line orthogonal to the straight line from the midpoint of the straight line is drawn toward the fine metal linear body side, and the distance (arrow height) between the midpoint and an intersecting point with the fine metal linear body is measured. The radius of curvature is obtained from the formula below.

$$r=(C\times C)/(8\times h)+h/2$$

(where r represents the radius of curvature, C represents the chord length, and h represents the arrow height)

The above-described radius of curvature is preferably from 0.5 to 1000 μm.

If the fine metal linear body is bent, the fine metal linear body is approximated as a shape having a curved portion, and the radius of curvature is obtained using the above-mentioned formula. Furthermore, when a straight line connecting the two ends of the fine metal linear body is drawn, if the straight line crosses the fine metal linear body, the fine metal linear body is taken as different fine metal linear bodies at the point of crossing, and the radius of curvature is measured.

If the fine metal linear body of the present invention is an aggregate including a plurality of fine metal linear bodies, it is inevitable that the aggregate includes particles with a shape other than the linear shape. It will be appreciated that, from the viewpoint of suppressing a decrease in the conductivity even when the aggregate is deformed (e.g., bent or stretched), it is preferable that particles with a shape other than the linear shape are not included in the aggregate to the fullest extent possible.

When the proportion of particles with a shape other than the linear shape in the aggregate is defined as "deformation rate", the deformation rate is preferably 50% or less, more preferably 40% or less, even more preferably 30% or less, even more preferably 10% or less, and even more preferably 2% or less. It is easy to make the deformation rate to 50% or less by producing fine metal linear bodies using the producing method described later.

The deformation rate is obtained by observing a measurement sample using an SEM in a field of view in which both the horizontal and lateral lengths are 5 to 30 times the average length of the fine metal linear body, and calculating the percentage of [(area of portions with deformed shape)/(area of linear body)]. The "deformed shape" refers to a shape other than the linear shape (e.g., a spherical shape, a lumpy shape, a fern leaf-like shape, etc.).

Next, a preferable method for producing the fine metal linear body of the present invention will be described. An electrolytic method is preferably used to produce the fine metal linear body. The reason for this is that an electrolytic method not only makes it easy to control the shape of the fine metal linear body to a desired shape but also allows an electrolyte to be used repeatedly, which reduces the amount of liquid required to produce the fine metal linear body and also reduces the amount of waste liquid to be processed. An atomization method is another method to produce a metal powder, but this method cannot produce objects with anisotropic shapes such as fine metal linear bodies. A wet reduction method (electroless reduction method) is also another production method, but this method cannot allow a solution to be used repeatedly and cannot increase the concentration of the target metal elements beyond a certain level, which reduces the productivity of the fine metal linear body.

When producing the fine metal linear body using an electrolytic method, for example, an anode and a cathode are immersed in a sulfuric acid electrolyte containing a metal element source, a direct current is applied thereto to cause electrolytic reduction to occur, so that a fine metal linear body is deposited on the surface of the cathode, the deposited fine metal linear body is scraped off by mechanical or electrical means and collected, and the collected fine metal linear body is washed with water or an organic solvent, dried, and sieved as necessary.

As long as a fine metal linear body can be produced using this production method, there is no particular limitation on the type of metal element that is used in the production method. Considering the balance between high conductivity and ease of industrial use, examples thereof include copper, silver, gold, nickel, lead, palladium, platinum, cobalt, tin, iron, bismuth, and zinc. Since these metal elements are common in that they can be electrolytically deposited from aqueous solution, they can be produced in a similar manner according to this production method regardless of which metal elements are used. Among these metal elements, it is preferable to use copper, a copper alloy, zinc, or a zinc alloy as a base material.

The fine metal linear body obtained in this production method may be, for example, constituted only by a target metal element except for unavoidable impurities, or only by an alloy of a target metal element except for unavoidable impurities. Moreover, the fine metal linear body may be constituted by two or more of the above-listed metal elements in combination except for unavoidable impurities.

The inventor's investigations revealed that it is advantageous to perform electrolytic reduction under a state in which an oily substance is attached to the surface of the cathode when producing the fine metal linear body following the procedure described above. Reducing the ions of metal elements in such a state has the advantage that the reduction reaction can be controlled. The details are as follows.

The amount of oily substance to be attached to the cathode surface, expressed in terms of thickness, is on average several hundred nanometers or more, and preferably from approximately several to several hundred micrometers. However, the thickness varies locally due to swaying of the electrolyte or the like. Although few metal ions coexist in the oily substance, several droplets of electrolyte containing metal ions may float in the oily substance, or a very small amount of the electrolyte may be intermittently attracted to the vicinity of the electrode by the force of the electric field formed by the application of electricity. Under such circumstances, a metal reduction reaction occurs on the surface of the cathode, resulting in a locally deposited metal protrusion. Since the thickness of the oily material directly above such a protrusion is thinner than other parts of the cathode, the electrical resistance in that area is lowered, and the current is concentrated therein, causing the protrusion to grow as a linear body. In this manner, a fine metal linear body made of metal is formed through electrolysis.

As the growth of the fine metal linear body progresses, the linear body tends to droop and become curved due to its own weight. The electrical resistance of the oily substance prevents linear growth, and the fine metal linear body tends to become curved. Basically, fine metal linear bodies are formed through electrolysis according to the mechanism described above, but the detailed shape and structure vary depending on the type of oily substance used. They vary also depending on the composition and additives of the electrolyte as in the electrolytic deposition of ordinary metals.

Examples of the method for attaching the oily substance to the surface of the cathode include a method in which the oily substance is directly applied to the cathode surface, a method in which the cathode is immersed in the oily substance contained in a vessel so that the oily substance is attached to the cathode surface, and a method in which the oily substance is floated on the electrolyte and the cathode is immersed therein from above so that the oily substance is attached to the cathode surface. Moreover, examples thereof also include a method in which the oily substance is suspended in the electrolyte, and the electrolyte suspension is stirred so that the suspended oily substance collides with the surface of the cathode and is attached to as is to the cathode surface. Furthermore, if the oily substance has the property of dissolving in a small amount in the electrolyte, even if the suspended oily substance does not directly touch the electrode, the oily substance once dissolved in the electrolyte will be continuously adsorbed on the electrode surface, resulting in the same effect as if it adhered to the surface.

If the fine metal linear body is produced using the above-described method, the fine metal linear body has a polycrystalline structure in which a plurality of crystals are interlinked in the longitudinal direction. Furthermore, the [110] orientation of the crystals is unlikely to be preferentially oriented in the longitudinal direction. Moreover, in the fine metal linear body, the [111] orientation of the crystals is likely to be preferentially oriented in the longitudinal direction or the crystals are likely to be randomly oriented.

Moreover, if the fine metal linear body is produced using the above-described method, generation of deformed particles with a shape other than the linear shape can be suppressed to the fullest extent possible.

Examples of the oily substance that is attached to the surface of the cathode include various organic compounds that are poorly soluble or insoluble in water and are viscous enough to be retained on the surface of the cathode after being attached to the surface. Note that "poorly soluble or insoluble in water" refers to a solubility corresponding to an amount of 100 g or less per 1 L of water at the temperature at which the fine metal linear body is produced.

The oily substance can be in liquid or solid form. The oily substance may be used in after being dissolved in a liquid solvent at room temperature (20 to 30° C.).

For the purpose of facilitating control of the physical properties of the fine metal linear body that is to be deposited, additives such as benzoic acid, fumaric acid, citric acid, or benzotriazoles may be further contained in the oily substance.

Examples of the organic compound include an aliphatic hydrocarbon, an aromatic hydrocarbon, an aliphatic alcohol, an aromatic alcohol, an aliphatic aldehyde, an aromatic aldehyde, an aliphatic ether, an aromatic ether, an aliphatic ketone, an aromatic ketone, an aliphatic carboxylic acid and a salt thereof, an aromatic carboxylic acid and a salt thereof, an amide of an aliphatic carboxylic acid, an amide of an aromatic carboxylic acid, an ester of an aliphatic carboxylic acid, an ester of an aromatic carboxylic acid, a silicone (e.g. dimethyl silicone), an aliphatic amine, an aromatic amine, a nitrogen-containing heterocyclic compound, a tributyl phosphate, a thiol, a fluorinated solvent, and an ionic liquid with the proviso that they are poorly soluble or insoluble in water. Note that the "aliphatic alcohol" as used in the present description is an alcohol with 5 or more carbon atoms.

The inventor's investigations revealed that the fine metal linear body can be more efficiently produced by using a fatty acid, or a salt, an ester, or an amide thereof, an aromatic carboxylic acid, an aliphatic hydrocarbon, an aliphatic alcohol, an aliphatic amine, a silicone (e.g., dimethyl silicone), or a mixture thereof as an oily substance.

Examples of the fatty acid include lower and higher fatty acids. Examples of the lower fatty acid include saturated or unsaturated aliphatic carboxylic acids preferably with 9 or less carbon atoms. Examples of the higher fatty acid include saturated or unsaturated aliphatic carboxylic acids with preferably 10 to 25 carbon atoms, more preferably 10 to 22 or less carbon atoms, and even more preferably 11 to 20 carbon atoms.

Examples of the saturated aliphatic carboxylic acid include caproic acid, enanthic acid, caprylic acid, pelargonic acid, capric acid, undecylic acid, lauric acid, tridecylic acid, myristic acid, pentadecylic acid, palmitic acid, margaric acid, stearic acid, nonadecylic acid, arachidic acid, heneicosylic acid, behenic acid, tricosylic acid, and lignoceric acid.

Examples of the unsaturated aliphatic carboxylic acid include those with one or at least two unsaturated carbon bonds in the molecule.

Examples of the unsaturated aliphatic carboxylic acid with one unsaturated carbon bond in the molecule include crotonic acid, myristoleic acid, palmitoleic acid, sapienic acid, oleic acid, elaidic acid, vaccenic acid, gadoleic acid, eicosenoic acid, erucic acid, and nervonic acid.

Examples of the unsaturated aliphatic carboxylic acid with at least two unsaturated carbon bonds in the molecule include linoleic acid, eicosadienoic acid, docosadienoic acid, and linolenic acid.

Examples of the aromatic carboxylic acid include benzoic acid, phthalic acid, isophthalic acid, terephthalic acid, hemimellitic acid, trimellitic acid, trimesic acid, mellophanic acid, prehnitic acid, pyromellitic acid, mellitic acid, diphenic acid, toluic acid, xylic acid, hemellitic acid, mesitylenic acid, prehnitylic acid, γ-isodurylic acid, durylic acid, β-isodurylic acid, mesitoic acid, α-isodurylic acid, cuminic acid, uvitic acid, α-toluic acid, hydratropic acid, atropic acid, hydrocinnamic acid, cinnamic acid, salicylic acid, anisic acid, cresotic acid, o-homosalicylic acid, o-cresotic acid, m-homosalicylic acid, m-cresotic acid, p-homosalicylic acid, p-cresotic acid, o-pyrocatechuic acid, β-resorcylic acid, gentisic acid, γ-resorcylic acid, protocatechuic acid, α-resorcylic acid, vanillic acid, isovanillic acid, veratric acid, o-veratric acid, orsellinic acid, m-hemipinic acid, gallic acid, syringic acid, asaronic acid, mandelic acid, vanillylmandelic acid, homoanisic acid, homogentisic acid, homoprotocatechuic acid, homovanillic acid, homoisovanillic acid, homoveratric acid, o-homoveratric acid, homophthalic acid, homoisophthalic acid, homoterephthalic acid, phthalonic acid, isophthalonic acid, terephthalonic acid, benzilic acid, atrolactic acid, tropic acid, melilotic acid, phloretic acid, hydrocaffeic acid, hydroferulic acid, hydroisoferulic acid, p-coumaric acid, umbellic acid, caffeic acid, ferulic acid, isoferulic acid, sinapic acid, benzoyl, phthaloyl, isophthaloyl, terephthaloyl, toluoyl, xyloyl, cumoyl, α-toluoyl, hydratropoyl, atropoyl, hydrocinnamoyl, cinnamoyl, salicyloyl, anisoyl, cresotoyl, o-pyrocatechuoyl, β-resorcyloyl, gentisoyl, γ-resorcyloyl, protocatechuoyl, α-resorcyloyl, vanilloyl, isovanilloyl, o-veratroyl, veratroyl, galloyl, syringoyl, mandeloyl, vanilmandeloyl, homogentisoyl, homovanilloyl, homoveratroyl, benziloyl, tropoyl, caffeoyl, feruloyl, perbenzoic acid, ibuprofen, ketoprofen, and felbinac.

Among the fatty acids mentioned above, it is preferable to use saturated and unsaturated aliphatic carboxylic acids because the fine metal linear body can be more efficiently produced.

The ester of the fatty acid is preferably an ester with a saturated or unsaturated aliphatic alcohol. The number of carbons of the alcohol is preferably from 1 to 18. The ester of the fatty acid is more preferably an ester with a saturated aliphatic alcohol with 1 to 18 carbon atoms. Examples of such an ester include ethyl acetate.

The amount of oily substance that is attached to the surface of the cathode is preferably from 0.1 to 500 $g/m^2$, more preferably from 1 to 500 $g/m^2$, even more preferably from 3 to 200 $g/m^2$, and even more preferably from 5 to 100 $g/m^2$, per unit surface area of the cathode.

As materials for the anode and the cathode, conventionally known materials can be used without particular limitation. For example, an anode and a cathode made of titanium or copper can be used. For the anode, an insoluble metal electrode (DSE) can also be used.

Regarding this aspect, the current density during reduction is preferably from 5 to 3000 $A/m^2$, more preferably from 10 to 1000 $A/m^2$, and even more preferably from 50 to 500 $A/m^2$.

Typically, in metal deposition through electrolysis, a good surface shape (e.g., in the case of plating, a state where metallic luster is obtained on the surface) can be obtained by energizing an amount of electricity corresponding to a reduction rate slower than the rate of supply of metal ions from the electrolyte. In the electrolysis according to the present invention as well, the concentration of metal element ions in the electrolyte is a concentration that allows metal ions to be supplied without excess or deficiency in the reaction rate of reduction of metal ions, and, from this viewpoint, the concentration of metal ions is preferably from 1 to 80 g/L, and more preferably from 1 to 60 g/L.

From a similar point of view, the electrolyte is preferably stirred or circulated in the electrolytic bath during electrolysis.

The electrolyte may be used in an unheated state, such as at room temperature (25° C.), or in a heated state.

Moreover, from a similar point of view, it is preferable to adjust the size of the electrolytic bath, the number of electrodes, the shape of the electrodes (plate or drum), the distance between electrodes, the oscillation of the electrodes, and the amount of electrolyte circulated so that the concentration of metal ions in the electrolyte near the electrodes is always kept high.

The fine metal linear body of the present invention obtained using the above-described method can be combined with another material to impart conductivity to the material. For example, the fine metal linear body of the present invention can be combined with a granular material made of the same or different metal elements to form a bonding material. Alternatively, a composition containing the fine metal linear body of the present invention and a dispersion medium can be used as a bonding material. These bonding materials can also be sintered to form sintered compacts. These bonding materials and sintered compacts are used, for example, as materials for bonding semiconductor devices and substrates.

Specifically, in a bonding structure including a first member, a second member, and a bonding portion that bonds the first member and the second member, the bonding portion may be constituted by a sintered compact of a composition containing the fine metal linear body of the present invention and a dispersion medium. Alternatively, in a semiconductor apparatus including a first member, a second member, and a bonding portion that bonds the first member and the second member, a semiconductor device may be used as at least one of the first member and the second member, and the bonding portion may be constituted by a sintered compact of a composition containing the fine metal linear body of the present invention and a dispersion medium.

It is also possible to produce an electronic circuit component using the fine metal linear body of the present invention. For example, in an electronic circuit component including a substrate and a conductive pattern formed on the substrate, the conductive pattern may be constituted by a sintered compact of a composition containing the fine metal linear body of the present invention and a dispersion medium.

Various organic solvents can be used, for example, as the dispersion medium contained in the composition. Examples of the organic solvents include monoalcohols, polyhydric alcohols, polyhydric alcohol alkyl ethers, polyhydric alcohol aryl ethers, esters, ketones, nitrogen-containing heterocyclic compounds, amides, amines, and saturated hydrocarbons. These organic solvents can be used alone or in a combination of two or more.

The fine metal linear body of the present invention can also be contained in a resin to form a resin composition containing the fine metal linear body and the resin. This resin composition has conductivity because it contains the fine metal linear body.

In order to impart conductivity to a resin, for example, the fine metal linear body may be dispersed in the resin. Alternatively, a layer containing the fine metal linear body may be formed on the surface of a base material containing the resin. In either case, the resin composition can be molded into various shapes. For example, it can be molded into one-dimensional shapes such as fibers, two-dimensional shapes such as films, plates and strips, and various three-dimensional shapes. In any of these shapes, the resin composition exhibits sufficient conductivity with the addition of a relatively small amount of fine metal linear body. The resin composition differs from conventional conductive resin compositions containing copper powder as filler in that the conductivity is unlikely to decrease before and after the resin composition is stretched or bent. From this point of view, the properties of the fine metal linear body of the present invention are effectively exhibited when the resin composition is stretchable or bendable. Conventional conductive resin compositions are prone to decrease in conductivity when they are stretched or bent.

As described above, the fine metal linear body of the present invention can be used in various forms. Specific applications of the fine metal linear body of the present invention include those in which the fine metal linear body is required to be conductive and is deformed by external force, such as wearable devices that are attached to a living body, flexible displays, and the like. In addition, the fine metal linear body of the present invention can be used for low linear expansion coefficient wiring materials, anisotropic conductive films, anisotropic heat transfer films, anode current collectors for lithium batteries, materials for filling via holes in printed circuit boards, sensors, switches, adsorption separation devices, electrocatalysts for various electrochemical reactions, current collectors for power generation elements, and the like.

EXAMPLES

Hereinafter, the present invention will be described more specifically by way of examples. However, the scope of the present invention is not limited to these examples. Unless otherwise stated, "%" means "mass %".

Example 1

In this example, a linear body made of copper was produced.

An electrolyte was prepared from copper sulfate and sulfuric acid such that the concentration of copper ions was 4 g/L and the concentration of free sulfuric acid was 5 g/L, and 800 mL of the electrolyte was placed in an electrolytic bath with a size of 10 cm×8 cm×12 cm (capacity of about 1000 mL) and stirred. The liquid temperature of the electrolyte was set to 40° C.

An 8 cm×8 cm copper plate was used as a cathode. Oleic acid was uniformly applied to the surface of the cathode. The amount of oleic acid applied was 7 g/m$^2$. An 8 cm×8 cm copper plate was used as an anode. The cathode and the anode were suspended in the electrolytic bath such that the distance therebetween was 8 cm.

Electrolysis was performed for 30 minutes under the condition that the current density was 160 A/m$^2$. In this manner, copper was electrodeposited on the surface of the cathode.

The copper electrodeposited on the surface of the cathode was collected and the collected copper was washed with ethanol. When the resulting electrodeposited material was observed using an SEM, it was seen that linear bodies had been produced. Each end of the linear bodies had a tapered shape.

FIG. 1 shows SEM images of the linear bodies obtained in this example. In the drawing, the SEM image at 30000× is shown to observe the end shape of the linear bodies.

Example 2

An electrolyte was prepared such that the concentration of copper ions was changed to 1 g/L, and electrolysis was performed under the condition that the current density was changed to 63 A/m$^2$. An electrodeposited material was obtained in a similar way to that of Example 1 except for these aspects.

When the resulting electrodeposited material was observed using an SEM, it was seen that linear bodies had been produced. Each end of the linear bodies had a tapered shape.

Example 3

An electrolyte was prepared such that the concentration of copper ions was changed to 7 g/L, and electrolysis was performed under the condition that the current density was changed to 63 A/m$^2$. An electrodeposited material was obtained in a similar way to that of Example 1 except for these aspects.

When the resulting electrodeposited material was observed using an SEM, it was seen that linear bodies had been produced. Each end of the linear bodies had a tapered shape.

Example 4

An electrolyte was prepared such that the concentration of copper ions was changed to 10 g/L. An electrodeposited material was obtained in a similar way to that of Example 1 except for this aspect.

When the resulting electrodeposited material was observed using an SEM, it was seen that linear bodies had been produced. Each end of the linear bodies had a tapered shape.

Example 5

An electrolyte was prepared such that the concentration of copper ions was changed to 40 g/L, and electrolysis was performed under the condition that the current density was changed to 310 A/m$^2$. An electrodeposited material was obtained in a similar way to that of Example 1 except for these aspects.

When the resulting electrodeposited material was observed using an SEM, it was seen that linear bodies had been produced. Each end of the linear bodies had a tapered shape.

Comparative Example 1

This comparative example corresponds to M. J. Kim, et. al., Journal of the American Chemical Society, 2017, vol. 139, p. 277-284.

First, 40 mL of 15 mol/L sodium hydroxide solution, 0.30 mL of ethylenediamine, and 2.0 mL of 0.1 mol/L copper nitrate solution were placed in a 100-mL four-necked flask, and stirred with a stirrer. The concentration of ethylenediamine in the copper salt solution was 137 mmol/L. The heater was set to 40° C. and the temperature was increased. Then, 50 μL of 35% hydrazine solution was injected into the flask using a syringe. After stirring with a stirrer for 60 minutes, the heater was turned off. Then, the mixture was cooled down to less than 30° C. in a water bath to obtain linear bodies. The resulting material was separated through filtration, dispersed in ethanol, subjected to ultrasonic dispersion, allowed to stand for 10 minutes, and separated into a supernatant (suspended solids) and a precipitate.

Figure 2:
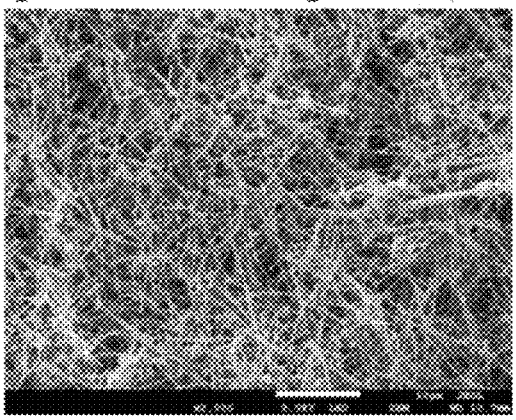
FIG. 2 shows scanning electron microscope images of fine metal linear bodies obtained in Comparative Example 1.
Figure 2:
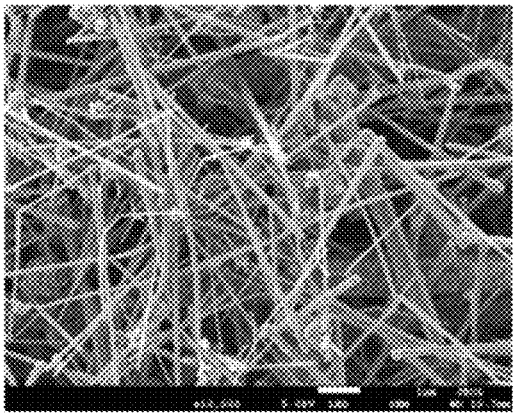
Figure 2:
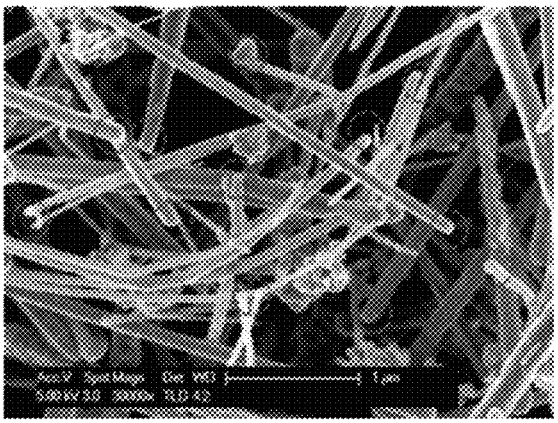

FIG. 2 shows SEM images of the linear bodies obtained in this comparative example. In the drawing, the SEM image at 30000× is shown to observe the end shape of the linear bodies.

Evaluation 1

The lengths, thicknesses, and radii of curvature of the linear bodies obtained in Examples 1 to 5 and Comparative Example 1 were measured using the above-described methods. In particular, the thickness of the linear bodies was obtained by reading the thicknesses of 10 or more linear bodies from an SEM image at a magnification at which the thickness can be sufficiently measured, and calculating their arithmetic mean, the SEM image specifically being an SEM image at 20000× in Example 1, an SEM image at 80000× in Example 2, an SEM image at 10000× in Example 3, an SEM image at 10000× in Example 4, an SEM image at 100× in Example 5, and an SEM image at 20000× in Comparative Example 1. Also, the length thereof was obtained by reading the lengths of 20 or more linear bodies from an SEM image at a magnification at which the length can be sufficiently measured, and calculating their arithmetic mean, the SEM image specifically being an SEM image at 10000× in Example 1, an SEM image at 20000× in Example 2, an SEM image at 5000× in Example 3, SEM images at 1000×, 2000×, and 5000× in Example 4, SEM images at 100×, 200×, and 500× in Example 5, and an SEM image at 5000× in Comparative Example 1.

Furthermore, the deformation rates of aggregates of the linear bodies obtained in Examples 1 to 5 and Comparative Example 1 were measured using the above-described method.

Moreover, the X, Y, and X/Y values and the crystal orientations of the crystals were measured using the following method. Table 1 below shows the results.

X, Y, and X/Y Values and Crystal Orientation of Crystals

The X, Y, and X/Y values of the crystals were obtained using the following method. The fine metal linear body was applied together with carbon paste to the copper plate, the coated film was cut to obtain a cross-section using an argon ion beam cross section polisher (Cross Section Polisher (CP) manufactured by JEOL Ltd.), and the cross-section was observed by creating a grain map of EBSD. As the carbon paste, Colloidal Graphite (Isopropanol Base) manufactured by Electron Microscopy Sciences was used. EBSD was performed using an SEM Crossbeam540 manufactured by Carl Zeiss and an EBSD detector: Symmetry mounted therein manufactured by Oxford Instruments. In the obtained grain map, the X and Y values of the crystals in three boundary regions when dividing the length of the fine metal linear body into four equal parts along the longitudinal direction were measured by referring to the scale in the figure, and the X/Y values were calculated. Their arithmetic means were calculated. The first decimal places of the arithmetic means were rounded off.

Figure 3:
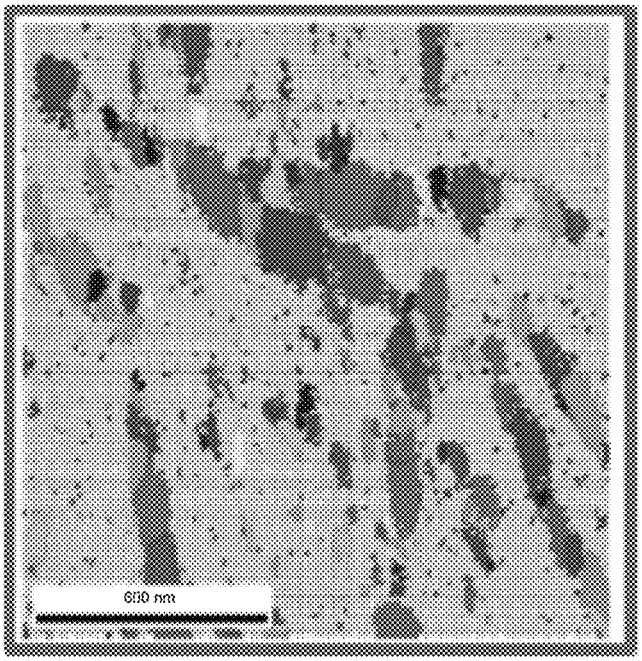
FIG. 3 shows a grain map of electron backscatter diffraction (grain map of EBSD) of the fine metal linear bodies obtained in Example 1.
Figure 4:
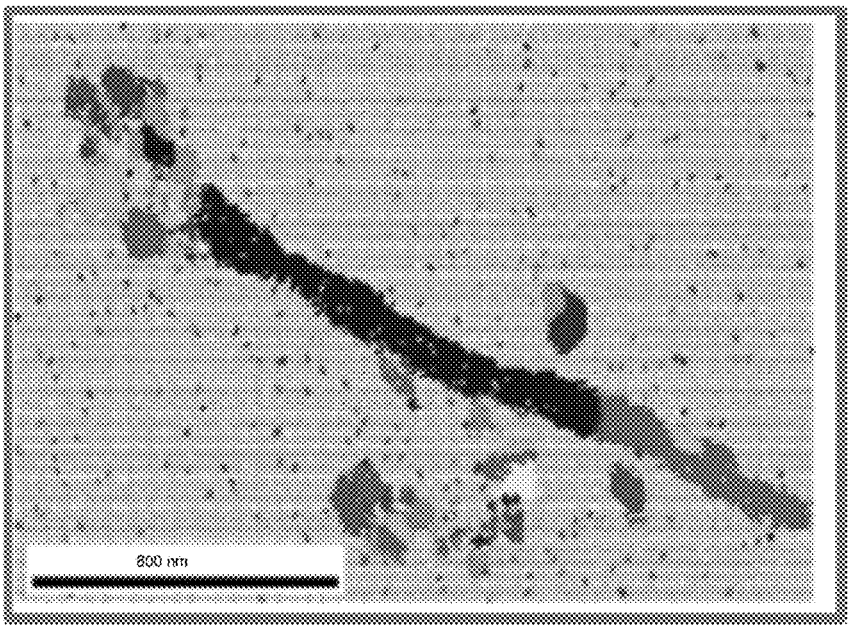
FIG. 4 shows a grain map of electron backscatter diffraction (grain map of EBSD) of the fine metal linear bodies obtained in Comparative Example 1.

FIGS. 3 and 4 respectively show grain maps of EBSD for measurement of the linear bodies of Example 1 and Comparative Example 1.

The crystal orientation was obtained using the following method. The fine metal linear bodies of Examples 1 to 4 and Comparative Example 1 were scattered on a copper grid and supported thereon. The observation was performed using a JEM-ARM200F manufactured by JEOL Ltd. Boundary lines dividing the length of each fine metal linear body into four equal parts along the extending direction were drawn, and, at midpoints of the boundary lines of the three boundary regions serving as the boundaries, the shapes were observed using a TEM, and electron diffraction patterns were obtained. The orientation was analyzed through electron diffraction using a digital micrograph manufactured by GATAN INC.

Furthermore, the fine metal linear body of Example 5 was kneaded into carbon paste and applied to the copper plate, and the coated film was cut to obtain a cross-section using an argon ion beam cross section polisher (Cross Section Polisher (CP) manufactured by JEOL Ltd.). The observation was performed using an SEM Crossbeam540 and an EBSD detector: Symmetry mounted therein. Boundary lines dividing the length of each fine metal linear body into four equal parts along the extending direction were drawn. At three points dividing each boundary line of three boundary regions serving as the boundaries into four equal parts, the crystal orientation was obtained through EBSD. The crystal orientation was analyzed through EBSD using an AZtec Crystal 2.0 manufactured by Oxford Instruments.

It was determined whether or not each orientation ([100] orientation, [110] orientation, and [111] orientation) as evaluated through TEM electron diffraction or EBSD was included within ±30° of the direction in which the fine metal linear body extended or its tangential direction (For each orientation, determination was performed using a normal line close to the ±30° range of the longitudinal direction. If two or more orientations are within ±30°, the orientation closer to 0° than the others was taken. Furthermore, if none of the three orientations are included within ±30°, it was regarded as "not preferentially oriented").

Regarding Examples 1 to 4 and Comparative Example 1, five arbitrarily extracted fine metal linear bodies were evaluated, and the percentage of crystal grains in which each orientation ([100] orientation, [110] orientation, and [111] orientation) was preferentially oriented was calculated from 15 evaluation results in total. Regarding Example 5, five arbitrarily extracted fine metal linear bodies were evaluated, and the percentage of crystal grains in which each orientation ([100] orientation, [110] orientation, and [111] orientation) was preferentially oriented was calculated from 45 evaluation results in total.

Evaluation 2

The specific resistances of sintered compacts produced from the linear bodies and particles obtained in Examples 1 to 5 and Comparative Example 1 were measured using the method described below. Table 1 shows the results.

Measurement of Specific Resistance

The linear bodies and particles obtained in Examples 1 to 5 and Comparative Example 1 were mixed with a varnish (terpineol and ethylcellulose), defoamed, and dispersed using three rolls to obtain a composition. The percentage of solids in the composition was 60% in Example 1, 55% in Example 2, 51% in Example 3, 57% in Example 4, 39% in Example 5, and 62% in Comparative Example 1.

This composition was applied to an alumina substrate, and heated to 220° C., 240° C., 260° C., and 300° C. at a heat increase rate of 10° C./min in a nitrogen atmosphere, and, after the temperature reached a target temperature, the alumina substrate was subjected to natural cooling to obtain a sintered compact. The specific resistance of this sintered compact was measured using a resistivity meter (MCP-T600 manufactured by Mitsubishi Chemical Corporation) according to the four-point probe method.

Note that the specific resistances of the sintered compacts sintered at 220° C. and 240° C. in Comparative Example 1 could not be measured because they exceeded $10^6$ Ω·cm, which was the upper limit of resistance measurement. These specific resistances are indicated as "$>10^6$" in Table 1.

TABLE 1

| | | Ex. 1 | Ex. 2 | Ex. 3 | Ex. 4 | Ex. 5 | Com.Ex. 1 |
|---|---|---|---|---|---|---|---|
| Physical properties of fine metal linear body and aggregate thereof | Length (μm) | 2.7 | 1.0 | 3.8 | 11 | 97 | 3.5 |
| | Thickness (nm) | 78 | 30 | 110 | 170 | 1260 | 94 |
| | Aspect ratio (length/thickness) | 35 | 33 | 35 | 65 | 77 | 37 |
| | Radius of curvature (μm) | 2.4 | 2.4 | 12.8 | 26.2 | 346 | 31.3 |
| | Radius of curvature/length | 0.89 | 2.4 | 3.4 | 2.4 | 3.6 | 8.9 |

TABLE 1-continued

| | | | Ex. 1 | Ex. 2 | Ex. 3 | Ex. 4 | Ex. 5 | Com.Ex. 1 |
|---|---|---|---|---|---|---|---|---|
| | Proportion of (Radius of curvature/length) ≤5 | | 90% | 92% | 70% | 80% | 70% | 32% |
| | Angle (°) of tapered end | | 33 | 46 | 41 | 34 | 32 | Not tapered |
| | Deformation rate (%) | | 1.0 | 9.6 | 1.0 | 3.0 | 2.4 | 20 |
| Physical properties of crystal | X (nm) | | 114 | 95 | 94 | 268 | 203 | 990 |
| | Y (nm) | | 97 | 62 | 63 | 139 | 220 | 90 |
| | X/Y | | 1.18 | 1.53 | 1.49 | 1.93 | 0.92 | 11 |
| | Proportion of crystal grains in [100] orientation | | 40% | 27% | 33% | 40% | 42% | 0% |
| | Proportion of crystal grains in [110] orientation | | 20% | 13% | 27% | 33% | 22% | 93% |
| | Proportion of crystal grains in [111] orientation | | 33% | 53% | 40% | 27% | 36% | 0% |
| Evaluation | Specific resistance (Ω · cm) | 220° C. | $8.12 \times 10^3$ | Not measured | Not measured | Not measured | Not measured | $>10^6$ |
| | | 240° C. | $1.54 \times 10^5$ | $2.74 \times 10^3$ | $3.63 \times 10^4$ | $6.75 \times 10^{-3}$ | $3.85 \times 10^{-1}$ | $>10^6$ |
| | | 260° C. | $6.46 \times 10^{-4}$ | $4.63 \times 10^{-5}$ | $2.07 \times 10^{-4}$ | $6.74 \times 10^{-5}$ | Not measured | $1.79 \times 10^{-3}$ |
| | | 300° C. | $1.20 \times 10^{-5}$ | $3.27 \times 10^{-5}$ | $3.65 \times 10^{-5}$ | $2.93 \times 10^{-5}$ | $3.45 \times 10^{-4}$ | $6.26 \times 10^{-4}$ |

As is clear from the results shown in Table 1, the sintered compacts produced from the linear bodies obtained in the examples have good low-temperature sintering properties. It is also seen that in the case of the same heating temperature, the electrical resistance of a sintered portion in the linear bodies obtained in the examples after the heat treatment is smaller than that in the linear body obtained in the comparative example.

INDUSTRIAL APPLICABILITY

The present invention provides a fine metal linear body in which the sintering temperature is lower than that in conventional examples, or, in the case of the same heating temperature, the electrical resistance of a sintered portion after the heat treatment is smaller than that in conventional examples.

The invention claimed is:

1. A fine metal linear body with a length of 0.5 to 200 μm and a thickness of 30 nm to 10 μm, wherein, when a length of a crystal of a metal constituting the fine metal linear body, in a direction in which the fine metal linear body extends, is taken as X, and a length thereof in a direction orthogonal to the direction is taken as Y, the crystal has an arithmetic mean of an X/Y value, which is a ratio of the X to the Y, of 4 or less, in three boundary regions when dividing the length of the fine metal linear body into four equal parts along the extending direction.

2. The fine metal linear body according to claim 1 with a length of 0.5 to 200 μm and a thickness of 30 nm to 10 μm, wherein, when a length of a crystal of a metal constituting the fine metal linear body, in a direction orthogonal to a direction in which the fine metal linear body extends, is taken as Y, the crystal has an arithmetic mean of the Y of 10 nm or less, in three boundary regions when dividing the length of the fine metal linear body into four equal parts along the extending direction.

3. The fine metal linear body according to claim 2 wherein, in the three boundary regions when dividing the length of the fine metal linear body into four equal parts along the extending direction, the crystal of the metal constituting the fine metal linear body has:

the proportion of crystal grains in a [111] orientation of 50% or more, as evaluated through electron diffraction using a transmission electron microscope or electron backscatter diffraction within ±30° of the direction in which the fine metal linear body extends; or the proportions of crystal grains in all of [100], [110], and [111] orientations.

4. The fine metal linear body according to claim 1 with a length of 0.5 to 200 μm and a thickness of 30 nm to 10 μm, wherein a crystal of a metal constituting the fine metal linear body has a proportion of crystal grains in a [110] orientation of 50% or less, as evaluated through electron diffraction using a transmission electron microscope or electron backscatter diffraction within ±30° of a direction in which the fine metal linear body extends, in three boundary regions when dividing the length of the fine metal linear body into four equal parts along the extending direction.

5. The fine metal linear body according to claim 1, wherein, in the three boundary regions when dividing the length of the fine metal linear body into four equal parts along the extending direction, the crystal of the metal constituting the fine metal linear body has:

the proportion of crystal grains in a [111] orientation of 50% or more, as evaluated through electron diffraction using a transmission electron microscope or electron backscatter diffraction within ±30° of the direction in which the fine metal linear body extends; or the proportions of crystal grains in all of [100], [110], and [111] orientations of 50% or less, as evaluated through electron diffraction using a transmission electron microscope or electron backscatter diffraction within ±30° of the direction in which the fine metal linear body extends.

6. The fine metal linear body according to claim 1, wherein at least one end is tapered, and an angle of the tapered end is 60 degrees or less.

7. The fine metal linear body according to claim 1, wherein the metal constituting the fine metal linear body is at least one metal selected from the group consisting of copper, silver, gold, nickel, lead, palladium, platinum, cobalt, tin, iron, bismuth, and zinc, or an alloy containing the metal.

8. The fine metal linear body according to claim 7, wherein the metal constituting the fine metal linear body is copper or a copper alloy.

9. A method for producing the fine metal linear body according to claim 1 using a metal as a base material, comprising a step of depositing the metal on a cathode through electrolytic reduction using an electrolyte containing a metal element source, wherein the electrolytic reduction is performed in a state in which an oily substance is attached to a surface of the cathode.

10. The method according to claim 9, wherein the oily substance is a fatty acid, or a salt, an ester, or an amide thereof, an aromatic carboxylic acid, an aliphatic hydrocarbon, an aliphatic alcohol, an aliphatic amine, a silicone, or a mixture thereof.

11. An aggregate of the fine metal linear bodies according to claim 1, wherein the number of fine metal linear bodies having a curved portion whose radius of curvature is 5 times or less the length of each fine metal linear body is 5% or more of the total number of fine metal linear bodies.

12. An aggregate of the fine metal linear bodies according to claim 1, wherein the proportion of particles with a shape other than the linear shape in the aggregate is 50% or less.

13. A composition comprising the fine metal linear body according to claim 1, and a dispersion medium.

14. A bonding structure comprising a first member, a second member, and a bonding portion that bonds the first member and the second member, wherein the bonding portion is constituted by a sintered compact of the composition according to claim 13.

15. A semiconductor apparatus comprising a first member, a second member, and a bonding portion that bonds the first member and the second member, wherein the bonding portion is constituted by a sintered compact of the composition according to claim 13, and at least one of the first member and the second member is a semiconductor device.

16. An electronic circuit component comprising a substrate, and a conductive pattern formed on the substrate, wherein the conductive pattern is constituted by a sintered compact of the composition according to claim 13.

* * * * *